US007380789B2

(12) United States Patent
Murrell et al.

(10) Patent No.: US 7,380,789 B2
(45) Date of Patent: Jun. 3, 2008

(54) METHODS OF MOVING A MEDIA SHEET FROM AN INPUT TRAY AND INTO A MEDIA PATH WITHIN AN IMAGE FORMING DEVICE

(75) Inventors: Niko Jay Murrell, Lexington, KY (US); Samuel Carter Sipper, Lexington, KY (US); William Paul Cook, Lexington, KY (US); Thomas George Fleming, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 353 days.

(21) Appl. No.: 11/149,519

(22) Filed: Jun. 10, 2005

(65) Prior Publication Data

US 2007/0001369 A1 Jan. 4, 2007

(51) Int. Cl.
*B65H 5/34* (2006.01)

(52) U.S. Cl. ..... 271/270; 271/256

(58) Field of Classification Search ..... 271/256, 271/258.01, 258.02, 270, 265.01, 266; 400/636; 399/396

See application file for complete search history.

(56) References Cited

U.S. PATENT DOCUMENTS 3,957,366 A * 5/1976 Taylor et al. ..... 399/394
4,025,187 A * 5/1977 Taylor et al. ..... 399/394
4,990,011 A * 2/1991 Underwood et al. ..... 400/636
5,246,224 A * 9/1993 Matsuno et al. ..... 271/242
5,280,899 A * 1/1994 Kida et al. ..... 271/10.1
5,355,206 A * 10/1994 Maruyama et al. ..... 399/396
5,461,468 A * 10/1995 Dempsey et al. ..... 399/396
5,462,373 A * 10/1995 Chia ..... 400/624
5,466,079 A * 11/1995 Quintana ..... 400/579
5,543,909 A * 8/1996 Quesnel ..... 399/394
5,564,848 A * 10/1996 Quintana ..... 400/708
5,678,127 A * 10/1997 Suga ..... 399/45
5,775,690 A * 7/1998 Quesnel et al. ..... 271/242
5,904,350 A * 5/1999 Creighton et al. ..... 271/227
6,010,127 A * 1/2000 DiCesare et al. ..... 271/259
6,065,886 A * 5/2000 Embry et al. ..... 400/629
6,227,534 B1 * 5/2001 Schoedinger et al. ..... 271/114
6,805,347 B2 * 10/2004 Kuramoto ..... 271/242
6,834,853 B2 * 12/2004 Trovinger et al. ..... 271/227
6,881,972 B2 * 4/2005 Butikofer et al. ..... 250/559.29
7,006,785 B2 * 2/2006 Embry ..... 399/388
7,063,318 B2 * 6/2006 Jacobs et al. ..... 271/226
2002/0063384 A1 * 5/2002 Quesnel ..... 271/270
2005/0206067 A1 * 9/2005 Cook et al. ..... 271/10.01
2006/0151940 A1 * 7/2006 Farmer et al. ..... 271/256

* cited by examiner

*Primary Examiner*—Patrick Mackey
*Assistant Examiner*—Gerald W McClain
(74) *Attorney, Agent, or Firm*—Coats & Bennett, P.L.L.C.

(57) ABSTRACT

The application is directed to methods for moving a media sheet through the media path of an image forming device. In one embodiment, the media sheet may be moved by a pick mechanism having a pick roll from an input tray. The pick roll in the input tray may maintain contact with the media sheet and drive the sheet at a first elevated speed as it moves towards the nip. The pick roll may then slow as it brings the leading edge into contact with the nip. This slower speed may reduce the amount of nip shock or compression that may cause reengagement of the pick mechanism and an unintentional double sheet feed. Moving the media sheet at the fast speed a majority of the distance along the media path between the input tray and nip may increase media throughput.

17 Claims, 4 Drawing Sheets

METHODS OF MOVING A MEDIA SHEET FROM AN INPUT TRAY AND INTO A MEDIA PATH WITHIN AN IMAGE FORMING DEVICE

BACKGROUND

Demand for smaller, less expensive image forming devices has created a unique set of media feed reliability problems. As the rate of images printed increases and machine size decreases, it has become increasingly difficult to reliably transfer media sheets through the system.

Media sheets move through an image forming device along a media path. The media path begins at the input point of the media sheet, such as an input tray or a manual feed position. The media may then move through the path along a series of rollers, belts, or combination of both. An image is formed on the media sheet as it moves along the media path. The sheet may be outputted from the device after an image is placed on a first side, or may be re-routed through a duplex path where another image is placed on a second side.

The speed and position of each media sheet is carefully monitored as it moves along the media path. A jam occurs when a media sheet does not arrive at a predetermined position along the media path at a predetermined time. A jam may be caused by a variety of different occurrences. One occurrence is when the media sheet is not accurately picked from the input tray. Another likely location for media jams is when the media sheet is moving along the media path and is passed from a first roller or belt to a second roller or belt.

Once a media jam occurs, the user may be required to access and remove the media sheets, and reset the device prior to continuing printing. This is frustrating to the user, and severely limits the output of the device. Methods and apparatus to reduce and/or eliminate jams and increase throughput are needed.

SUMMARY

The present invention is directed to embodiments of moving a media sheet through the media path of an image forming device. In one embodiment, the media sheet may be moved from an input tray by a pick mechanism. The pick mechanism in the input tray may maintain contact with the media sheet and drive the sheet at a first elevated speed from the time it exits the input tray until it approaches a nip. The pick mechanism may then slow as it brings the leading edge into contact with the nip. This slower speed may reduce the amount of nip shock or compression that may cause reengagement of the pick mechanism and an unintentional double sheet feed. Moving the media sheet at the fast speed a majority of the distance along the media path between the input tray and nip may increase media throughput.

DETAILED DESCRIPTION

The present invention is directed to embodiments of media feed mechanisms and methods for feeding media sheets within an image forming device. Embodiments include feeding a media sheet from an input tray to a roll that is operating at a different speed at the time the leading edge of the media sheet is brought into contact. The media sheet is slowed a predetermined amount prior to the leading edge contacting the roll.

Figure 1:
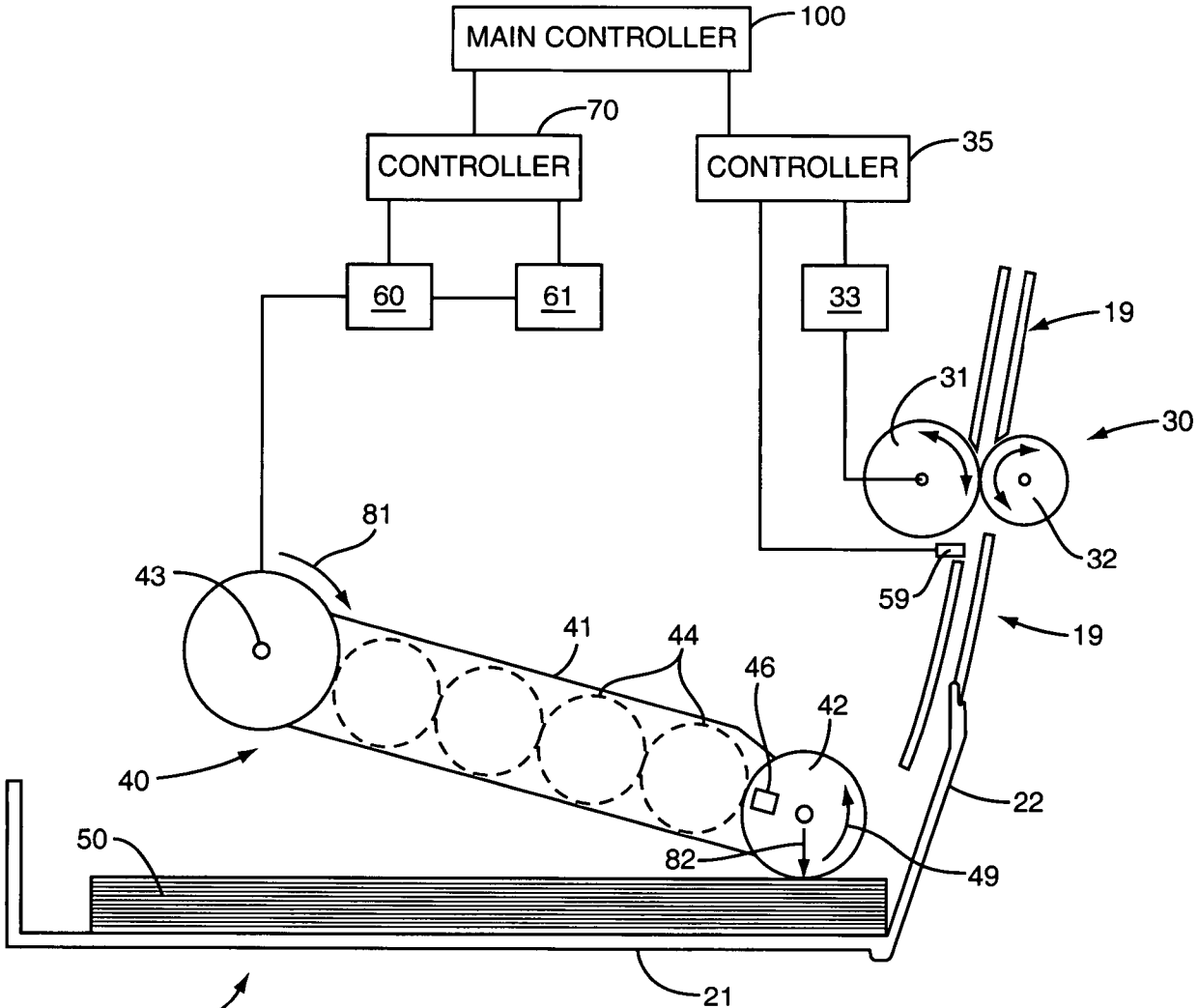
FIG. 1 is a schematic side view of an input tray and aligner roll according to one embodiment of the present invention.

FIG. 1 illustrates one embodiment of a section of an image forming device having an input tray 20 and aligner nip 30. The input tray 20 is sized to contain a stack of media sheets 50. The input tray 20 includes a bottom surface 21 on which the media sheets 50 rest, and a ramped surface 22 at the end adjacent to the media path 19. The ramped surface 22 is angled relative to the bottom surface 21. The top-most media sheet 50 in the stack is pushed against the ramped surface 22 by the media pick assembly 40 and deflected in an upward direction into the media path 19.

The media pick assembly 40 includes an arm 41 having a pick roll 42 on the distal end. The arm 41 pivots about point 43 causing gravity to maintain the pick roll 42 on the top most sheet of the stack of media sheets 50. Pick roll 42 rotates in the direction indicated by arrow 49 (i.e., counterclockwise as illustrated in the embodiment of FIG. 1) to move the top-most media sheet 50 out of the input tray 20 and into the media path 19. The pick arm 41 may include a drive train 44 for transferring a driving force to the pick roll 42. Drive train 44 may include a plurality of gears, pulleys, belts, and the like for transferring power from a motor 60 to rotate the pick roll 42. In the embodiment of FIG. 1, drive train 44 comprises a series of gears that extend through the pick arm 41. A power supply 61 is operatively connected to the motor 60.

In the embodiment of FIG. 1, motor 60 is separate from the pick arm 41 and operatively connected via a clutch or the like. The motor 60 may be a D.C. motor that is operatively connected to an electrical supply 61 which in turn is connected to a controller 70. Motor 60 further includes an encoder that is monitored by the controller 70 to control and regulate the speed of the motor. Controller 70 receives data representing the D.C. motor drive current. Controller 70 may further be operatively connected with the main controller 100 that oversees the entirety of the image formation process. Controller 100 may send pick and timing commands establishing the timing and speeds for picking the media sheet from the input tray 20.

In operation, a pick command is sent either by controller 70 or main controller 100. Rotation of the gears within the pick arm 41 causes a downward torque 81 to be applied to the pick arm 41 which is free to pivot about point 43. The gears 44 further rotate resulting in a counterclockwise rotation of the pick roll 42 as indicated by arrow 49. The system is designed for a 'no slip' condition and the applied torque causes an increase in the normal force in the direction indicated by arrow 82 between the pick roll 42 and the top most media sheet. The top most media sheet is pressed with increasing force until the pick roll 42 begins to rotate. As the pick roll 42 rotates, the frictional adhesion between the surface of the pick roll 42 and the top media sheet causes the top most sheet to move towards the ramped edge 22. The moved sheet contacts the ramped edge 22 at which time the restriction of movement of the sheet again hinders sheet movement. This hindrance causes the torque applied by the gears 44 to increase the normal force in the direction of arrow 82 between the pick roll 42 and the media sheet. The normal force will continue to build up until the media sheet buckles, and the buckled sheet is transported into the media path 19. The pick roll 42 then continues to rotate and feed the media sheet into the media path 19.

The aligner nip 30 is positioned directly downstream from the input tray 20. The aligner nip 30 functions to remove skew from the media sheet and further move the sheet through the media path 19. Aligner nip 30 includes a drive roll 31 in abutting contact with a driven roll 32. A motor 33 with encoder operatively connected to drive roll 31 rotates the drive roll in both forward and reverse directions. The driven roll 32 is rotated through the contact with the drive roll 31 and may not include any additional drive source. Controller 35 sends and receives signals from the motor 33 and encoder indicating the status of the aligner nip 30. A sensor 59 may be positioned along the media path between the input tray 20 and aligner nip 30. Main controller 100 may send and receive signals from controller 35. Controller 100 may send timing signals and speeds for controlling the movement of the media sheet through the aligner nip 30.

Figure 2:
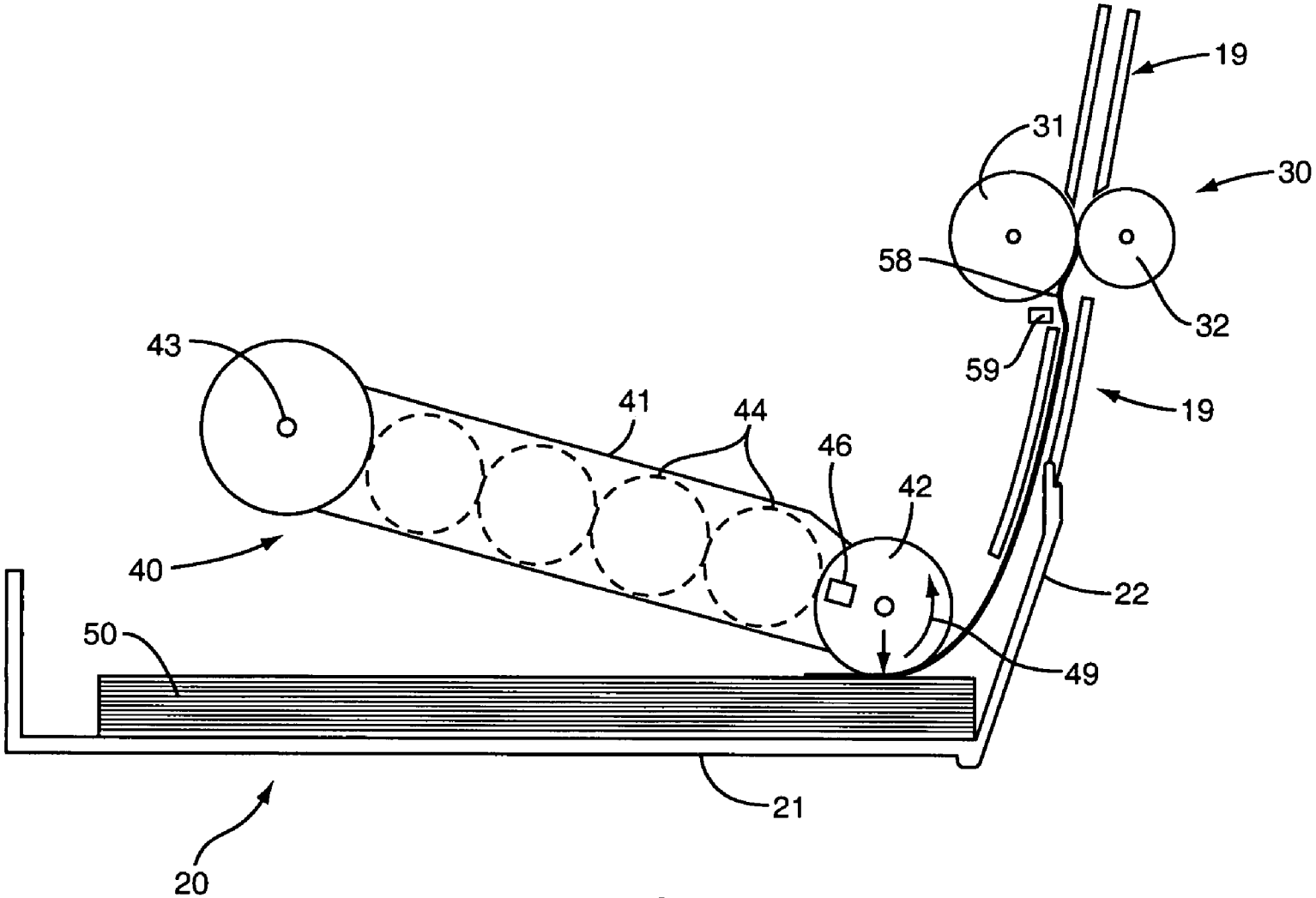
FIG. 2 is a schematic side view of the pick roll forming a buckle in the media sheet according to one embodiment of the present invention.

FIG. 2 illustrates the operation as the media sheet is moved along the media path 19 by the pick roll 42 and the leading edge contacts the aligner nip 30. At this point, the drive roll 31 and driven roll 32 are either rotating in a reverse direction, or stationary. A buckle 58 is formed in the media sheet as forward movement of the leading edge is stopped in the nip 30 while the pick roll 42 continues to rotate and drive the media sheet along the media path 19. The buckle 58 may form just prior to the nip as illustrated in FIG. 2, or further upstream at some point between the pick roll 42 and aligner nip 30. The buckle 58 causes the leading edge of the media sheet to align with the aligner nip 30 thus removing lateral skew.

The media shock or media compression as the leading edge contacts the aligner nip 30 and formation of the buckle 58 places additional resistance on the pick roll 42 as it rotates and drives the media sheet into the media path 19. This additional resistance may cause the pick assembly 40 to increase the normal force applied in direction 82. The amount of normal force applied through the pick assembly 40 impacts the frictional force between the pick roll 42 and the top most sheet. The increase in the normal force applied through the pick roll 42 further increases the frictional adhesion between the top most media sheet and the underlying sheets. If the normal force is increased beyond a certain amount, the frictional force between the two top sheets is strong enough for the two sheets to remain together and rotation of the pick roll 42 moves both sheets into the media path 19. This is referred to as a shingled double feed and results in a media jam. The jam requires the user to access the jammed sheets, and reset the image forming device prior to re-starting the image formation process.

The present invention identifies the issue of double feeds caused by the reengaging pick assembly 40 that is directly upstream from an aligner roll 30. The media sheet is moved along the media path at a first speed until the leading edge is in proximity to the aligner nip 30. The pick roll 42 than slows as it brings the leading edge in contact. This slower speed reduces the amount of nip shock or compression that causes the reengagement of the pick assembly 40. This also results in improved motor control as the slower speed results in smaller positional errors. Moving the media sheet at the fast speed a majority of the distance along the media path between the input tray 20 and aligner nip 30 advantageously increases media throughput through this section of the image forming device.

Figure 3:
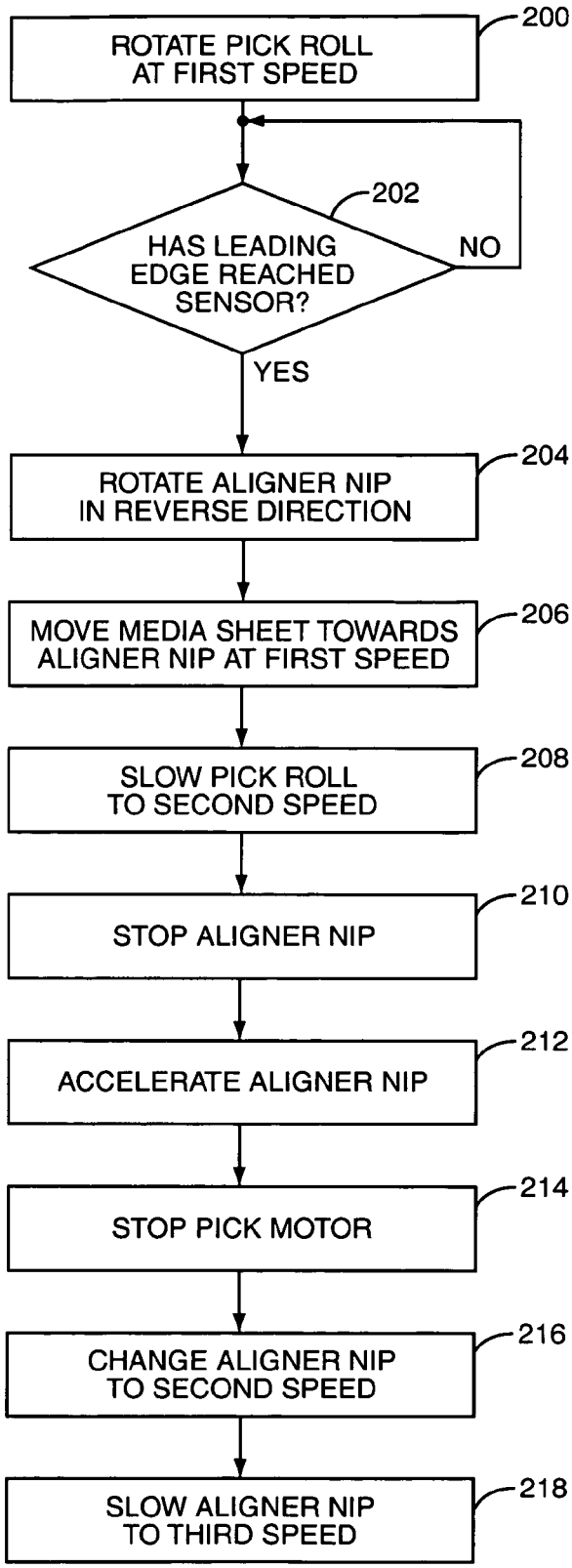
FIG. 3 is a flow-chart diagram illustrating the steps of feeding a media sheet according to one embodiment of the present invention.

FIG. 3 illustrates one method of overcoming the double feed issue when picking the media sheet. Initially, the pick roll 42 is rotated at a first fast speed (Step 200). In one embodiment, the speed is about 175 mm/s. The pick roll 42 is rotated and the leading edge of the top-most media sheet is driven from the input tray 50 and into the media path 19. The pick roll 42 continues to rotate and drive the media sheet until the leading edge reaches the sensor 59 (Step 202). Once the sensor 59 is activated, the aligner nip 30 begins to rotate in a reverse direction (Step 204). In one embodiment, the aligner nip 30 is run in a reverse direction at about 53 mm/s. As the aligner nip 30 is reversing, the pick roll 42 drives the media sheet further towards the aligner nip 30 (Step 206). Prior to the leading edge contacting the aligner nip 30, the speed of the pick roll 42 is reduced to a second speed (Step 208). In one embodiment, the second pick speed is about 53 mm/s.

After the leading edge contacts the aligner nip 30, the pick roll 42 continues to feed the media sheet at the second speed thereby forming a buckle 58. Prior to, during, or after buckle formation, the aligner nip 30 is stopped (Step 210). In one embodiment, a predetermined time to stop the aligner nip 30 is about 30 ms. The aligner nip 30 is then accelerated in the forward direction to a fast speed (Step 212). In one embodiment, the fast speed is about 175 mm/s. After the media sheet begins to move through the aligner nip 30, the pick motor 60 continues to drive the pick roll 42 to feed the media sheet into the media path 19 for a control distance and is then stopped (Step 214). In one embodiment, the control distance is about 5 mm.

The aligner nip 30 continues to run at the fast speed for a predetermined period and then slows to a second speed (Step 216). In one embodiment, the second speed is about 121 mm/s. The aligner nip 30 continues to operate at the second speed for a post-alignment control distance. The aligner nip 30 is then slowed to a third speed (Step 218). In one embodiment, the third speed is about 107 mm/s. The aligner nip 30 continues operating at this speed until the media sheet clears the nip.

The media sheet may still be in contact with the pick roll 42 at the time the pick roll 42 is stopped at step 214. A clutch 46 may be positioned on the pick arm 41 to allow for the pick roll 42 to continue to rotate after the motor 60 is stopped. The clutch allows the pick roll 42 to freely rotate without increasing drag on the media sheet which is now being driven by the aligner nip 30. Embodiments of a clutch 46 are disclosed in U.S. patent application Ser. Nos. 10/436,406 entitled "Pick Mechanism and Algorithm for an Image Forming Apparatus" filed on May 12, 2003, and 10/983,402 entitled "Clutch Mechanism and Method for Moving Media within an Image Forming Apparatus" filed on Nov. 8, 2004, both herein incorporated by reference in their entirety.

The embodiment illustrated in FIG. 3 discloses that the aligner nip 30 is rotated in a reverse direction when the leading edge of the media sheet is brought into contact. In another embodiment, the aligner nip 30 is stationary when the leading edge is brought into contact. After the buckle is formed, the aligner nip 30 is then rotated in a forward direction to move the media sheet through along the media path 19.

Figure 4:
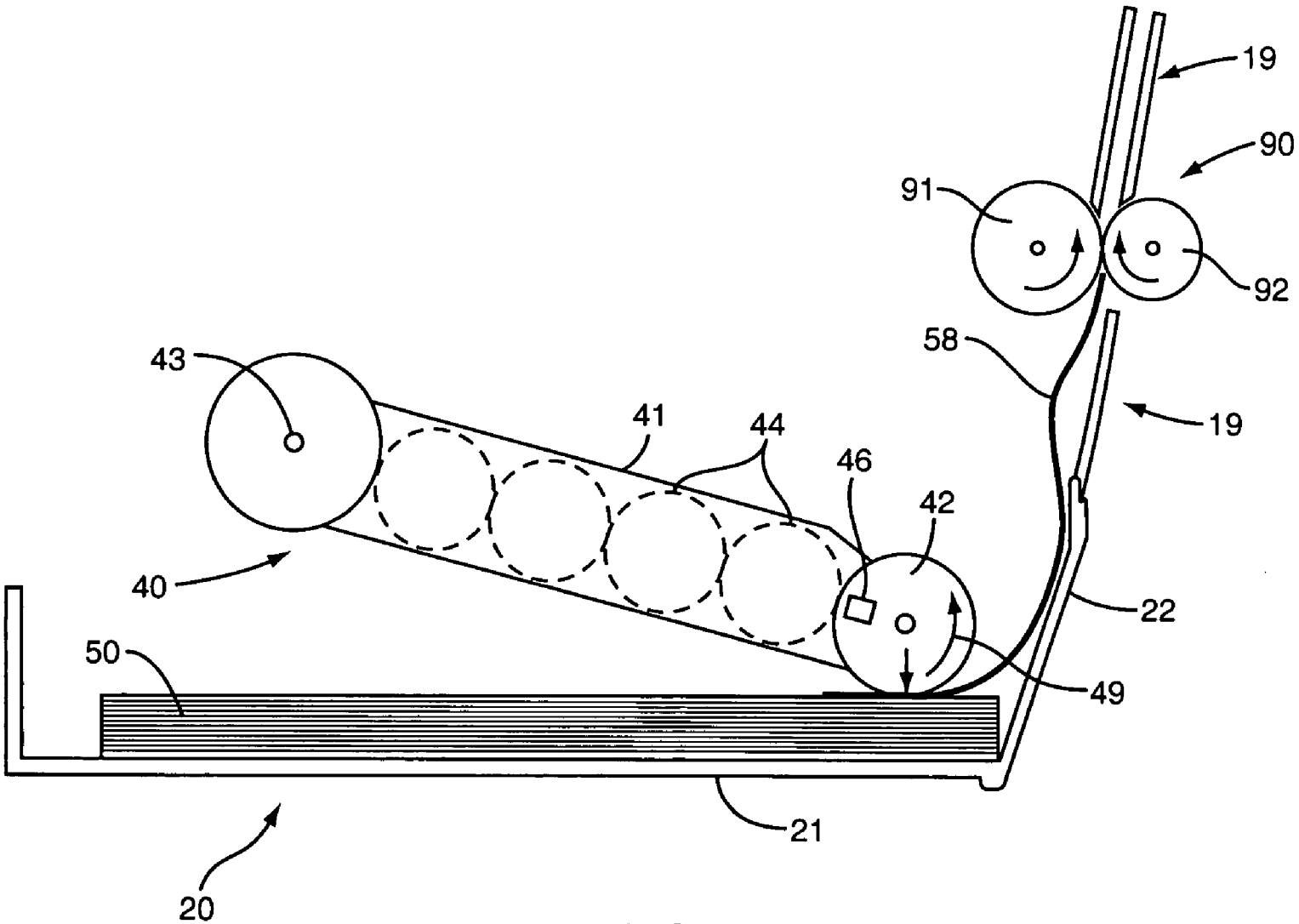
FIG. 4 is a schematic side view of the pick roll forming a buckle in the media sheet according to one embodiment of the present invention.

FIG. 4 illustrates another embodiment with a pick mechanism 40 feeding a media sheet into a nip 90 formed by rolls 91, 92. Nip 90 rotates in a forward direction to move the media sheet further along the media path 19. Nip 90 does not act to align the media sheet within the media path 19. Nip 90 operates at a slower speed than the pick roll 42. As no sensor is present, the speed of the media sheet is slowed to a speed closer to the nip speed at some point between the pick roll 42 and nip 90. When the leading edge contacts the nip 90, a buckle 58 is formed in the sheet caused by the mismatched speeds between the pick roll 42 and nip 90. The geometry of the media path 19 and the mismatched speed causes the buckle 58 to form at a point closer to the pick roll 42 than in the embodiment illustrated in FIG. 2.

In embodiments without sensors 59 in the media path 19, the position of the leading edge may be detected based on an open loop control. The position of the leading edge may also be based on encoder pulses from motor 60 that drives the pick roll 42.

In another embodiment, a buckle is not formed in the media sheet as it enters the aligner nip 30 or nip 90. The pick roll 42 drives the media sheet at an elevated speed greater than the aligner nip 30 or nip 90. Prior to the leading edge making contact, the speed of the pick roll 42 is reduced as the media sheet enters into the aligner nip 30 or nip 90.

In one embodiment, the pick roll 42 may further move the media sheet an additional amount after the leading edge activates the sensor 59. This skew correction amount ensures that skew is reduced or eliminated from the media sheet. In one embodiment, the sensor 59 is positioned about 10 mm from the aligner nip 30. Therefore, after leading edge detection, the pick roll 42 moves the media sheet the 10 mm to the aligner nip 30, and a 3 mm skew correction amount.

Various types of pick mechanisms may be used for moving the media sheet out of the input tray 20. One embodiment is disclosed in U.S. Pat. No. 6,227,534 herein incorporated by reference in its entirety.

The embodiment illustrated in FIG. 3 includes a two-speed pick profile. The media sheet is picked at a first speed and then slowed to a second speed as the leading edge approaches the nip 30, 90. Various other pick speed profiles may be used. One embodiment includes a triple phase profile. Another embodiment features a continuously decreasing speed profile with the media sheet continuously decreasing in speed as it approaches the nip 30, 90. Another embodiment features multiple stages of elevated and slowed speeds.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of moving a media sheet within an image forming device, the method comprising the steps of:

rotating a pick roll and moving the media sheet out of an input tray;

rotating the pick roll and driving the media sheet along a media path at a first speed;

determining that a leading edge of the media sheet is at a predetermined position in the media path;

after determining the leading edge of the media sheet is at the predetermined position, continuously slowing the pick roll to a second slower speed;

rotating the pick roll and contacting the leading edge against a nip while the media sheet is moving at the second slower speed;

rotating the pick roll at a faster speed than the nip and forming a buckle in the media sheet while the pick roll is still in contact with the media sheet; and rotating the nip in a forward direction and moving the media sheet through the nip.

2. The method of claim 1, further comprising applying a downward force on the media sheet by the pick roll while the media sheet is in the input tray.

3. The method of claim 1, further comprising rotating the nip in a reverse direction when the leading edge of the media sheet initially contacts the nip.

4. The method of claim 1, further comprising having the nip stationary when the leading edge of the media sheet initially contacts the nip.

5. The method of claim 1, further comprising feeding the media sheet directly from the input tray to the nip without passing through an intermediate roll.

6. The method of claim 1, further comprising clutching the pick roll and driving the media sheet through the nip.

7. The method of claim 1, wherein the step of determining that the leading edge of the media sheet is at the predetermined position along the media path comprises detecting the media sheet with a sensor positioned along the media path.

8. The method of claim 1, further comprising changing a speed profile of the media sheet moving along the media path between the input tray and the predetermined position.

9. The method of claim 1, further comprising aligning the leading edge of the media sheet at the nip.

10. A method of moving a media sheet within an image forming device, the method comprising the steps of:

moving the media sheet from an input tray and into a media path;

moving the media sheet a predetermined distance along the media path at a first speed;

slowing the media sheet to a second slower speed as a leading edge approaches a nip;

contacting the leading edge of the media sheet with the nip as the media sheet is moving at the second slower speed and a trailing edge of the media sheet remains in the input tray;

continuing to feed the media sheet towards the nip and forming a buckle in the media sheet as the trailing edge remains in the input tray; and continuously slowing the media sheet from the first speed towards the second speed as the media sheet moves towards the nip.

11. The method of claim 10, further comprising moving the media sheet through the nip a predetermined distance at a fast speed and slowing the media sheet to a slow speed.

12. The method of claim 10, further comprising applying a downward force on the media sheet as the media sheet is in the input tray.

13. The method of claim 10, wherein the step of slowing the media sheet to the second slower speed as the leading edge approaches the nip occurs when the leading edge passes through a sensor along the media path.

14. The method of claim 10, wherein the step of slowing the media sheet to a second slower speed as the leading edge approaches the nip occurs when a controller associated with a pick roll in the input tray detects that the leading edge is at a predetermined position along the media path.

15. The method of claim 10, further comprising shutting off a motor that drives a pick roll that moves the media sheet from the input tray towards the nip after the leading edge of the media sheet has passed through the nip and the media sheet is still in contact with the pick roll.

16. The method of claim 10, further comprising rotating the nip in a reverse direction and preventing the leading edge from moving through the nip when the leading edge initially contacts the nip.

17. The method of claim 10, further comprising maintaining the nip stationary and preventing the leading edge from moving through the nip when the leading edge initially contacts the nip.

* * * * *